United States Patent [19]

Mascaro

[11] 4,223,507

[45] Sep. 23, 1980

[54] COMPOSITE ALUMINUM JACK POLES

[76] Inventor: Thomas E. Mascaro, 1278 Laurel Ave., Warminster, Pa. 18974

[21] Appl. No.: 878,293

[22] Filed: Feb. 16, 1978

[51] Int. Cl.[2] ..... E04C 3/30

[52] U.S. Cl. ..... 52/730; 52/731; 182/219

[58] Field of Search ..... 52/368, 374, 373, 731, 52/732, 730, 632, 729; 182/145, 146, 142, 219

[56] References Cited

U.S. PATENT DOCUMENTS

| | | | |
|---|---|---|---|
| 742,549 | 10/1903 | Zeh | 52/731 |
| 1,475,409 | 11/1923 | Riddle | 52/374 |
| 1,552,474 | 9/1925 | Dornier | 52/731 |
| 2,342,916 | 2/1944 | Blaski | 52/642 |
| 2,851,747 | 9/1958 | Rolen | 52/731 |
| 3,333,389 | 8/1967 | Lichti | 52/732 |
| 4,070,845 | 1/1978 | Cody | 52/632 |
| 4,086,978 | 5/1978 | Clements | 182/82 |

FOREIGN PATENT DOCUMENTS

| | | | |
|---|---|---|---|
| 941123 | 2/1974 | Canada | 52/373 |
| 1484978 | 5/1969 | Fed. Rep. of Germany | 52/731 |
| 1002955 | 3/1952 | France | 52/368 |

*Primary Examiner*—Price C. Faw, Jr.
*Assistant Examiner*—Henry E. Raduazo
*Attorney, Agent, or Firm*—Howard I. Podell

[57] ABSTRACT

An aluminum-wood composite pole which comprises an elongated hollow aluminum member having a rectangular cross-section with front and back surfaces integral with oppositely facing recessed connecting sides. Bolted in the recesses are wooden facings to allow gripping thereot by jump jacks used on scaffolding.

1 Claim, 3 Drawing Figures

COMPOSITE ALUMINUM JACK POLES

FIELD OF THE INVENTION

This invention relates generally to improved poles for building scaffolding.

DESCRIPTION OF THE PRIOR ART

The prior art, as exemplified by U.S. Pat. Nos. 2,777,660; 150,005; 1,714,044; 3,160,228; 1,904,656 and 722,498 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use or to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in an aluminum-wood composite pole which comprises an elongated hollow aluminum member having a rectangular cross-section with front and back surfaces integral with oppositely facing recessed connecting sides. Bolted in the recesses are wooden facings to allow gripping thereof by pump jacks used on scaffolding.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
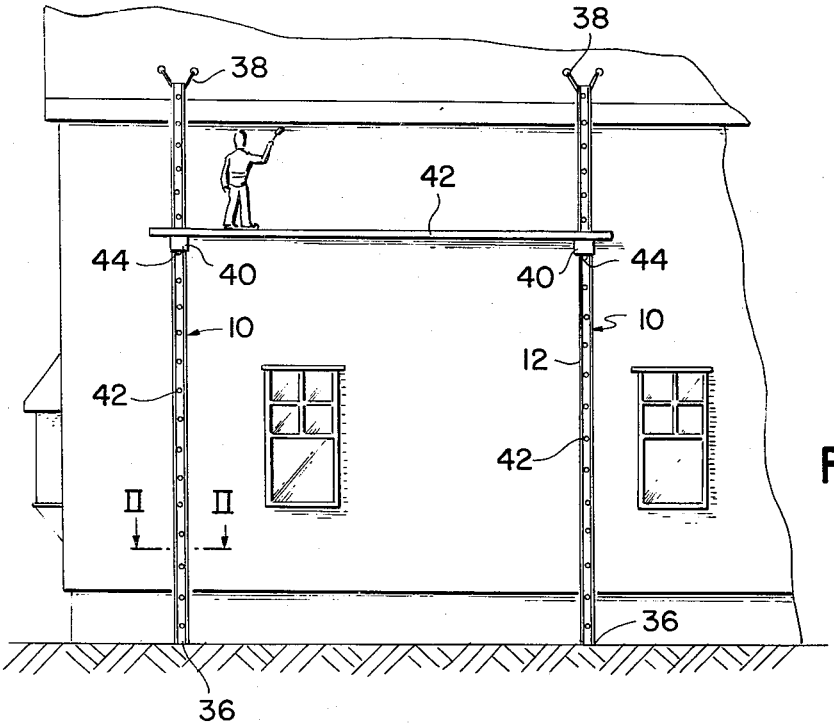
FIG. 1 is a front elevation showing use of the improved poles of the invention for building scaffolding.
Figure 2:
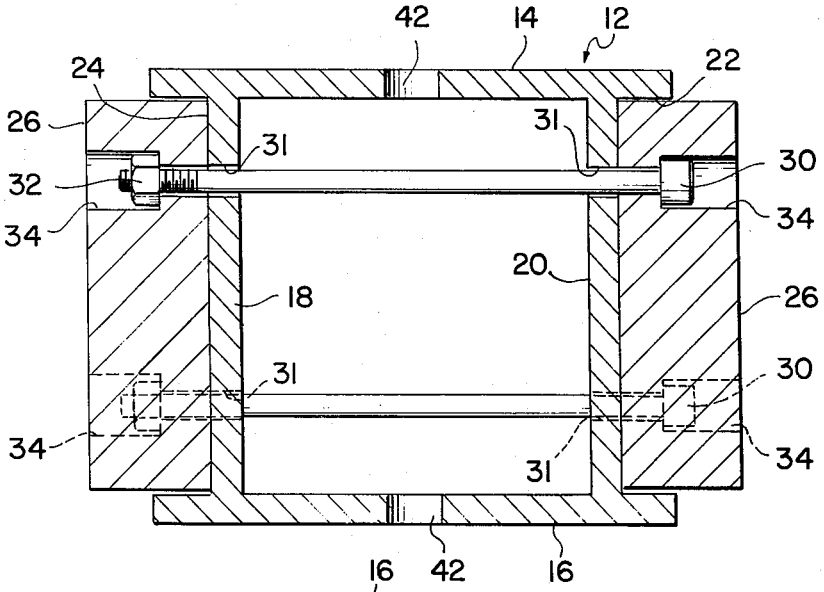
FIG. 2 is a cross-sectional view along line II—II of FIG. 1.

With reference to the drawing, there is shown and illustrated a pole for erecting scaffoldings constructed in accordance with the principles of the invention and designated generally by reference character 10. The illustrated tangible embodiment of the invention includes an elongated aluminum member 12 which suitably can measure from eighteen to twenty feet in length with a width of about three and one-half inches. The member 12 is hollow and generally rectangular with the front and back walls 14, 16 extending beyond side walls 18 and 20 to form lateral recesses 22 and 24. Wooden one by three inch facings 26 are bolted to each recess by ¼ inch bolts 30 and nuts 32 which pass through transverse openings 31. The heads of the bolts 30 and nuts 32 are countersunk and fit in recesses 34 in the wooden facings.

Figure 3:
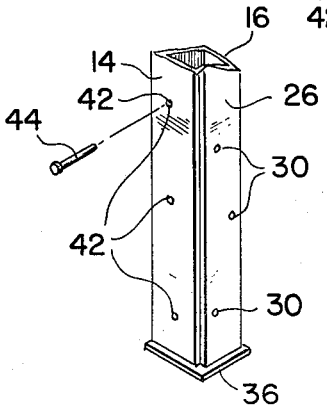
FIG. 3 is a fragmentary perspective view of the pole.

To reduce the tendency of the wood to split, the bolts 30 and holes 31 are staggered as shown in FIG. 3, and spaced by about twenty-four inches.

The poles 10 have a flat base 36 adapted to rest on the ground and securing means 38 at their top for attaching to a wall.

The wooden facings 26 provide a gripping surface for the pump jacks 40 which support plank 42. The facings are replaceable when worn by use. For longer life, bolts 30 are as short as possible to avoid hitting the jacks.

Pump jacks operate by the same action as auto tire jacks.

The present poles are intended to replace the wooden two by four's nailed together which are now used and bend or break easily.

The poles of this invention do not bend and will not break even with a five-hundred to six-hundred pounds load. They are fifty percent lighter and easier to handle than the present wooden poles.

As an added safety factor, a plurality of transverse, aligned, openings 42 are provided in aluminum sides 14 and 16 to allow insertion of anchoring pin 44 which will prevent the pump jacks 40 from slipping. Preferably, the openings 42 will be one-half inch in diameter and one foot apart.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A vertical support pole of a scaffold which pole is adapted for use with a pump jack of the scaffold, comprising an elongated hollow aluminum member of substantially rectangular cross-section fitted at one end with a flat base adapted to rest on ground when the pole is in the vertical erect position, with a pair of opposed sides of said pole each shaped with a continuous recess extending substantially for the length of the pole, with a wooden member fastened in each said recess and extending for a substantially length of the pole, each said wooden member extending beyond the side of the pole in which it is fastened so as to serve as a facing engageable by a pump jack of the scaffold, together with a plurality of openings formed in each of the other two opposed sides of the support pole, with each opening in one of said sides located at a position with regard to an opening in the other of said sides such that an anchoring pin may be detachably fitted through both of said openings so as to serve as a detachable anchor for the pump jack, when the pump jack of the scaffold is to be held in place, including a plurality of staggered openings in said recesses and in said facings and securing means passing therethrough, wherein said facings have recessed openings for receiving therein bolts with countersunk heads and securing nuts.

* * * * *